United States Patent [19]

Wasson

[11] 3,953,311

[45] Apr. 27, 1976

[54] CATHODIC PROTECTION SYSTEM

[75] Inventor: Loerwood C. Wasson, Milwaukee, Wis.

[73] Assignee: A. O. Smith Corporation, Milwaukee, Wis.

[22] Filed: Apr. 25, 1974

[21] Appl. No.: 463,897

Related U.S. Application Data

[63] Continuation-in-part of Ser. No. 298,286, Oct. 17, 1972, abandoned.

[52] U.S. Cl. ..... 204/197; 204/148

[51] Int. Cl.[2] ..... C23F 13/00

[58] Field of Search ..... 204/147, 148, 196, 197

[56] References Cited

UNITED STATES PATENTS

| | | | |
|---|---|---|---|
| 1,646,736 | 10/1927 | Mills | 204/197 |
| 1,705,197 | 3/1929 | Mills | 204/197 |
| 3,542,663 | 11/1970 | Alewitz | 204/197 |

OTHER PUBLICATIONS

Moore, "Corrosion", Vol. 9, pp. 112–114.

Farr, "Corrosion", Vol. 9, pp. 108–111.

*Primary Examiner*—T. Tung

*Attorney, Agent, or Firm*—Andrus, Sceales, Starke & Sawall

[57] ABSTRACT

A cathodically protected internal joint between two tubular members coupled together and which are provided as part of a fluid conducting system. One of the tubular members tends to be anodic to the other tubular member. In order to prevent corrosion dissipation of the more anodic tubular member, material more anodic than the tubular members is provided internally of the joint to provide cathodic protection to the fluid exposed inner surface of the tubular members at the joint area by release of electrons outwardly of the anodic material.

5 Claims, 3 Drawing Figures

Fig. 1
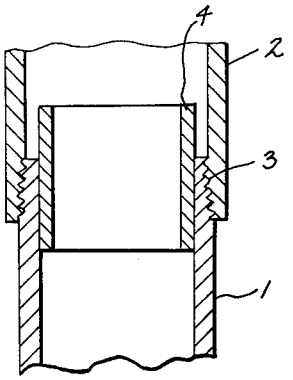
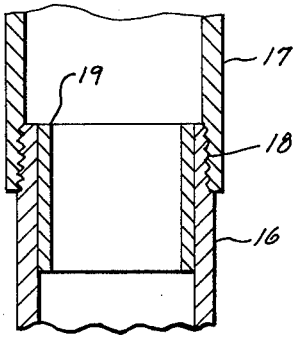
Fig. 3
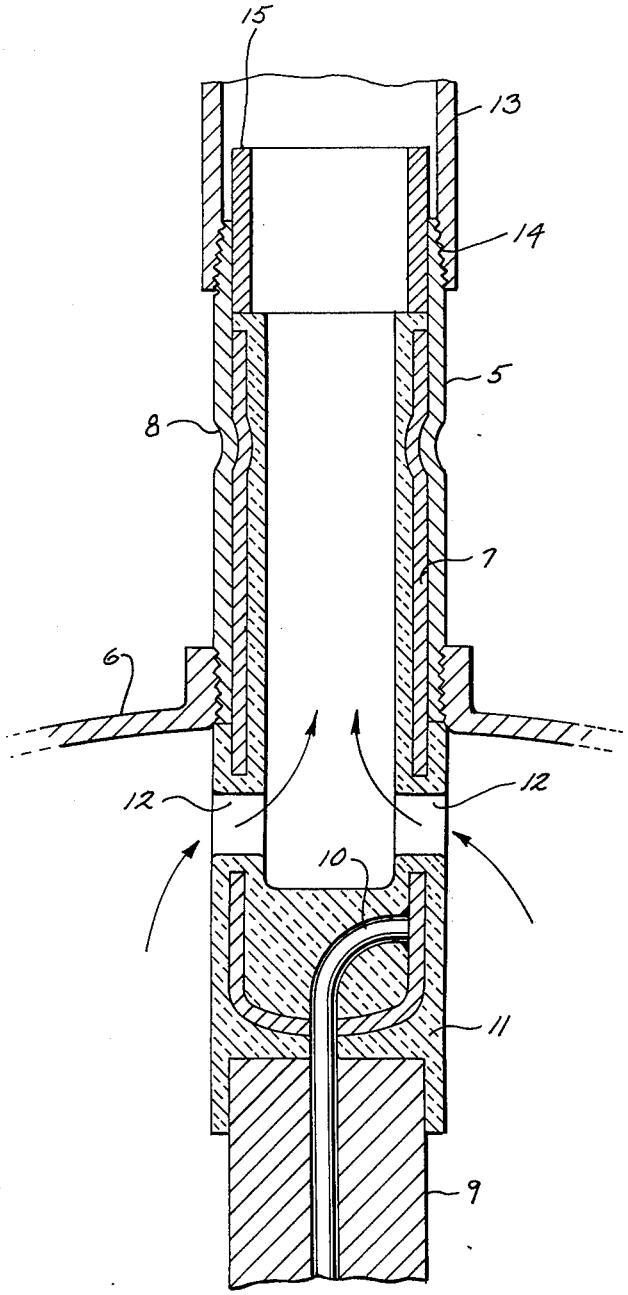
Fig. 2

CATHODIC PROTECTION SYSTEM

CROSS REFERENCE TO RELATED APPLICATION

This application is a continuation-in-part of application Ser. No. 298,286 filed Oct. 17, 1972, now abandoned.

BACKGROUND OF THE INVENTION

There is a serious need in the plumbing industry to prevent internal corrosion of tubular joints and the invention provides one way to meet this need by the use of cathodic protection. One particular area where the invention has successfully been applied is in the cathodic protection of the internal surfaces of joints between steel nipples employed in water heaters and brass tubing coupled to the nipples through which hot water flows as it is withdrawn from a water heater. The difference in potential between the steel and brass forms a corrosion cell at the joint between the brass and steel which the invention overcomes.

SUMMARY OF THE INVENTION

Under one embodiment of the invention at the internal joint area between a water heater nipple and service tubing secured thereto or at the joint between two tubes or pipes, a separate ring of material more anodic than the members joined together is located inside the innermost tubular member at the joint area and projects within the outermost tubular member or is located within the innermost tubular member and substantially flush with the end of the inner tubular member. A material such as aluminum or zinc is normally employed as the material in the ring.

Under another embodiment of the invention at the internal joint between two tubular members providing a water conducting system in a water heater a ring of material more anodic than the joined members is disposed within the innermost member substantially flush with the end of the innermost tubular member.

In the internal area of the joint the anodic ring of material will tend to protect the tubular members from corrosion as the electrons gradually leave the anodic material outwardly to the cathodic areas of the tubular members. At internal joint areas between two tubular metal members there will be a difference in potential between the two metal members particularly if the members are made of different metals. However, even in the case of two tubular members of the same metal there are anodes and cathodes in the various portions of each member and one member will tend to be anodic to the other. With a material more anodic than the tubular members of the fluid conducting system being disposed internally within the joint between them, it is assured that no corrosion will occur on the two tubular members at the joint area.

DESCRIPTION OF THE DRAWING FIGURES

The drawing furnished herewith illustrates the best modes of the invention presently contemplated by the inventor and discloses the above advantages and features as well as others which will be understood from the detailed description thereof.

In the drawing:

FIG. 1 is a longitudinal sectional view of tubular members of different metals which are threaded together with an internal ring of anodic material at the joint area;

FIG. 2 is another embodiment of the invention illustrating a ring of anodic material applied internally of the nipple of a water heater and extending within a service outlet tube of different material than the nipple; and FIG. 3 is a view similar to the upper portion of FIG. 2 in which a ring of anodic material is disposed substantially flush with the end of the nipple of a water heater to which is threaded a service outlet tube.

DESCRIPTION OF THE ILLUSTRATED EMBODIMENTS

Referring to FIG. 1 of the drawing there is shown a tubular member 1 which for the purposes of this description is of steel and a second or outer tubular member 2 of brass is threaded thereon to provide the internal joint 3 between the two members. Because tubular member 1, for the purpose of illustrating the problem, is more anodic than tubular member 2, metallic ions will be discharged from tubular member 1 to pass to the less anodic tubular member 2 through the fluid flowing internally of the joint 3 in an attempt to protect the cathode member 2 from corrosion and in turn thereby be gradually dissipated.

In order to overcome the effect of the corrosion cell formed in the internal joint between tubular members 1 and 2 and protect the members 1 and 2 and the threads at joint 3 from corrosion, FIG. 1 illustrates ring 4 of material such as aluminum or zinc which is anodic to the metal of tubular members 1 and 2 and press fitted inside of inner tubular member 1.

As illustrated in FIG. 1, the inner portion of ring 4 is in intimate engagement with tubular member 1 to securely hold ring 4 in place and establish the contact required for a cathodic system to protect tubular members 1 and 2 from corrosion at internal joint 3 and the outer portion of ring 4 projects within the tubular members 2 at joint 3. Ring 4 is also in contact with any fluid flowing through joint 3.

FIG. 2 illustrates the employment of the invention in connection with the hot water discharge nipple assembly of a water heater. In this embodiment the nipple 5 which ordinarily is of steel is threaded into the upper head 6 of a water heater (not shown) and projects outwardly therefrom.

A galvanized steel tube 7 extends within nipple 5 and projects inwardly from nipple 5 into the inside of the water heater. Nipple 5 is rolled inwardly as at 8 to secure tube 7 to nipple 5 in tight contact with each other. At the inner end of tube 7, an anode 9 such as of magnesium is secured to tube 7 by welding the steel core wire 10 to tube 7. The exposed steel surfaces of tube 7 are covered with molded insulation material 11 at the lower end and on the inside of the extent of tube 7 within nipple 5. Hot water outlet openings 12 are provided in tube 7 and through the lower portion of insulation material 11 for discharge of hot water from the heater through nipple 5.

At the upper or outboard end of nipple 5 the service conduit 13 usually of brass is threaded thereon to provide the internal joint 14.

Beyond the upper end of tube 7 a ring 15 of more anodic material than nipple 5 or conduit 13 such as aluminum or zinc is press fitted at its lower end within nipple 5 and extends across the internal joint 14 and within the service conduit 13 to cathodically protect the outboard end of nipple 5 and internal joint 14 from corrosion. The press fit of ring 15 within nipple 5 disposes ring 15 in intimate contact with nipple 5 and in contact with the water flowing through nipple 5.

In the embodiment of the invention illustrated in FIG. 3, there is provided the nipple 16, ordinarily of steel, which is threaded into the upper head of a water heater such as the head 6 of FIG. 2 and projects outwardly therefrom.

At the upper end of nipple 16 the service conduit 17, usually of brass, is threaded thereon to provide the internal joint 18.

A ring 19 of material more anodic than the nipple or service conduit such as of aluminum or zinc is press fitted into the outboard end of nipple 16 in intimate contact therewith so that the outer end of the ring 19 is flush with or substantially flush with the outer end of the nipple 16 and disposed to be in contact with the water flowing through the nipple 16 and service conduit 17. This construction overcomes the effect of the corrosion cell formed in joint 18 and protects the threads at the joint, nipple 16 and conduit 17 against corrosion.

Research and tests have clearly indicated that the cathodic protection of metal surfaces within a joint area is better accomplished with those surfaces located outside a ring of anodic material compared to the protection given metal surfaces located inside a ring of anode material. It is believed that the explanation for this difference in effect is that the electrons which are released from the anode tend to seek metal structures which are outside the anode because of the electrostatic nature of the separate charges.

The result of nipple corrosion tests have shown that there is only a very slight amount of difference in the corrosion protection provided by anode rings which extend beyond the end of the nipple as compared to anode rings which are flush with the outboard end of the nipple. In both cases, the amount of corrosion was so small that the indications had to be read in the discoloration of scale rather than in the amount of penetration of the iron into the nipple.

In another set of tests, a steel ring was located inside an aluminum anode ring and the assembly was press fitted inside the end of a steel nipple. The results showed that the aluminum anode ring did not protect the steel ring inside the anode ring as well as it protected the steel nipple outside the ring.

The invention, besides being employed to cathodically protect an internally threaded joint between tubular members, is also applicable to protect internal joints where other coupling means may be employed.

The invention overcomes with a simple inexpensive solution the problem of corrosion of internal joints in piping systems particularly where dissimilar metals are joined together.

Various modes of carrying out the invention are contemplated as being within the scope of the following claims particularly pointing out and distinctly claiming the subject matter which is regarded as the invention.

I claim:

1. A cathodically protected internal joint of a water conducting system in a water heater, which comprises a first tubular conduit secured to the water heater, a second tubular conduit threaded onto the outboard end of the first tubular conduit to form a joint therebetween and provide for flow of water through the joint area, one conduit tending to be anodic with respect to the other conduit, and a ring of material more anodic than the said conduits secured internally of said first conduit in intimate contact therewith but having a portion of the outer cylindrical surface of the ring exposed so as to release electrons outwardly to provide cathodic protection at the joint area for said conduits exposed to the water flow therethrough.

2. The protected internal joint of claim 1 in which the ring of anodic material is secured to the first tubular conduit by a press fit.

3. The protected internal joint of claim 1 in which the anodic material is aluminum.

4. The protected internal joint of claim 1 in which the anodic material is zinc.

5. A cathodically protected internal joint of a water conducting system in a water heater, which comprises a first tubular conduit secured to the water heater, a second tubular conduit threaded onto the outboard end of the first tubular conduit to form a joint therebetween and provide for flow of water through the joint area, one conduit tending to be anodic with respect to the other conduit and a ring of material more anodic than the said conduits secured internally of said first conduit in intimate contact therewith and projecting therefrom across the joint and into the second tubular conduit to expose the outer surface of the anode ring to the second tubular conduit, the threaded joint and the outer end of the first conduit to provide cathodic protection at the joint area for said conduits exposed to the water flow therethrough.

* * * * *